US008745822B2

(12) United States Patent
Garrett

(10) Patent No.: US 8,745,822 B2
(45) Date of Patent: Jun. 10, 2014

(54) HINGE JOINT

(75) Inventor: Rodney Gene Garrett, Fort Madison, IA (US)

(73) Assignee: KL MEGLA GmbH, Eitorf (DE)

( * ) Notice: Subject to any disclaimer, the term of this patent is extended or adjusted under 35 U.S.C. 154(b) by 0 days.

(21) Appl. No.: 13/368,158

(22) Filed: Feb. 7, 2012

(65) Prior Publication Data

US 2013/0000079 A1 Jan. 3, 2013

Related U.S. Application Data

(60) Provisional application No. 61/440,060, filed on Feb. 7, 2011.

(51) Int. Cl.
*E05D 5/02* (2006.01)

(52) U.S. Cl.
CPC ..... *E05D 5/0246* (2013.01)
USPC ..... 16/252

(58) Field of Classification Search
CPC ..... E05D 5/0246; E05D 11/1064
USPC ..... 16/252, 253, 281, 379, 332, 334, 292, 16/293, 344, 303, 304, 286, 327, 331, 284
See application file for complete search history.

(56) References Cited

U.S. PATENT DOCUMENTS

| | | | | |
|---|---|---|---|---|
| 5,297,313 | A | 3/1994 | Brin | |
| 5,867,869 | A | 2/1999 | Garrett et al. | |
| 6,161,255 | A | 12/2000 | Garrett | |
| 6,519,811 | B1 | 2/2003 | Cheng | |
| 6,826,870 | B2 * | 12/2004 | Chiang | 49/388 |
| 6,925,685 | B2 * | 8/2005 | Chen | 16/252 |
| 6,966,150 | B2 * | 11/2005 | Chiang | 16/252 |
| 7,594,302 | B2 * | 9/2009 | Balenzano | 16/252 |
| 2005/0050685 | A1 * | 3/2005 | Chen | 16/332 |
| 2005/0144757 | A1 * | 7/2005 | Chiang | 16/252 |
| 2008/0083087 | A1 * | 4/2008 | Lin | 16/252 |
| 2008/0168621 | A1 * | 7/2008 | Lin | 16/252 |

FOREIGN PATENT DOCUMENTS

EP 0 599 255 B1 6/1994

* cited by examiner

*Primary Examiner* — Jeffrey O Brien
(74) *Attorney, Agent, or Firm* — Hodgson Russ LLP

(57) ABSTRACT

The invention is a hinge having a first joint part a second joint part and at least one articulated axle element. A locking device selectively locks the first joint part relative to the second joint part. A basic element is arranged at the first joint part. A holding device, having at least one articulated axle seat, is arranged at the second joint part. The articulated axle element is arranged at the articulated axle seat, and is arranged at the basic element. The locking device has at least one first clamping plane arranged at the articulated axle element, and a first clamping element arranged at the holding device. The first clamping element comprises a second clamping plane. The first clamping plane is located at the second clamping plane to lock the first joint part in relation to the second joint part.

16 Claims, 10 Drawing Sheets

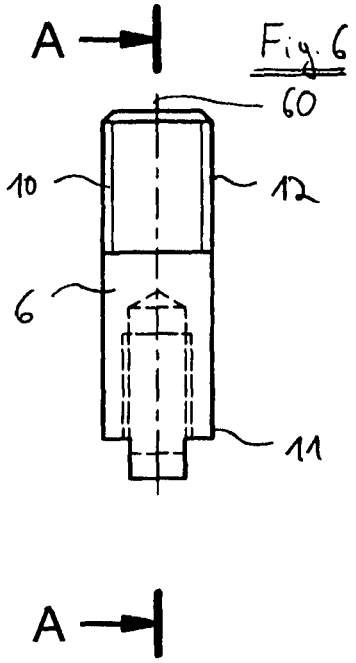
Fig. 6
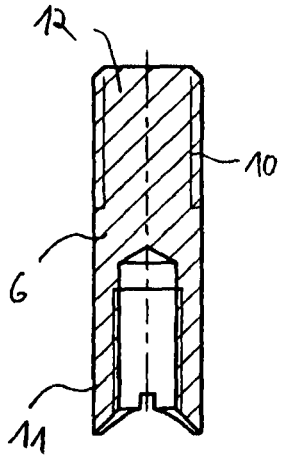
Fig. 7
Fig. 8
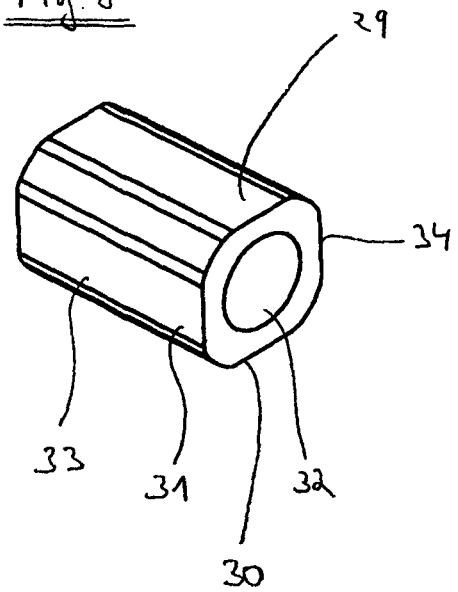
Fig. 9
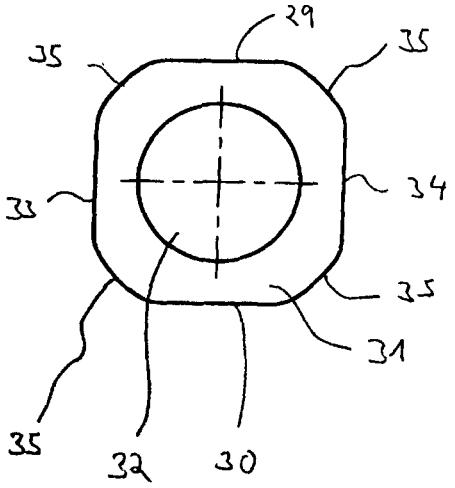

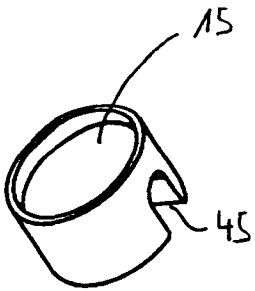
Fig. 20
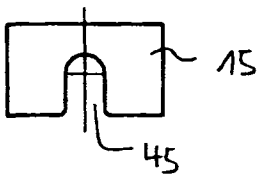
Fig. 21
Fig. 17
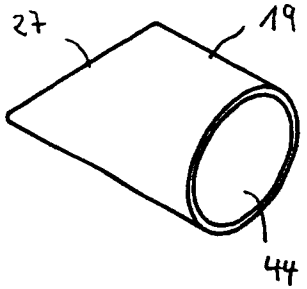
Fig. 18
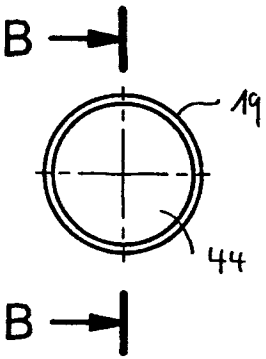
Fig. 19
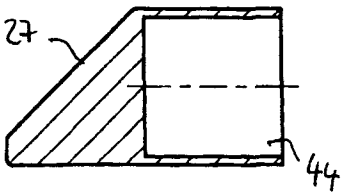

HINGE JOINT

CROSS-REFERENCE TO RELATED APPLICATION

This application claims the benefit of priority to U.S. provisional patent application Ser. No. 61/440,060, filed on Feb. 7, 2011.

FIELD OF THE INVENTION

The present invention relates to a hinge, for example for doors or windows. The invention may be particularly well suited for use with a glass door, and in particular, a glass shower door.

BACKGROUND OF THE INVENTION

U.S. Pat. No. 6,161,255 depicts a prior art device representative of the state of the art. A hinge is known from the state of the art that is equipped with a first joint part and a second joint part. The first joint part and the second joint part are connected by an articulated axle so that the first joint part can rotate in relation to the second joint part around a rotational axis. The known hinge furthermore has a locking device to lock the first joint part in a relative position with respect to the second joint part. This relative position, for example, is an open position or the closed position of a door. A catching device is provided on the first joint part of the known hinge to lock it in the relative position. The catching device comprises a first recess and a second recess. Both recesses are located on the joint axle. In one position, a first catching device enters into the first recess. In addition, a second catching device enters into the second recess. Each catching device is exposed to a coil spring element. The coil springs are diametrical to each other so that the joint axis is located between the two coil springs.

In the prior art, after a certain time of load on a known hinge (namely after a certain time during which the door is always moved from a first position into a second position using the known hinge), there is always the danger that the limiting areas of the first recess and the second recess in the known hinge become worn due to material abrasion and fatigue, and that these recesses become flattened. This reduces the secure lock of the first joint part in the relative position with respect to the second joint part.

SUMMARY OF THE INVENTION

The invention may be embodied as a hinge which ensures a secure lock of a first joint part in a relative position with respect to a second joint part. In one embodiment, the invention is achieved by a hinge having a first joint part, a second joint part, a locking device, a basic element which is arranged at the first joint part, and a holding device arranged at the second joint part. The first joint part is connected in hinge form to the second join part around an articulated axle element such that the first joint part can rotate in relation to the second joint part around a rotational axis. The locking device locks at least one relative position of the first joint part in relation to the second joint part. The holding device has at least one articulated axle seat where the axle element is positioned and arranged at the basic element.

The locking device is made of at least one first clamping plane which is arranged at the articulated axle element. The locking device also comprises at least one first clamping element arranged at the holding device. The first clamping element has a second clamping plane. The first clamping plane is located at the second clamping plane to lock a relative position of the first joint part in relation to the second joint part. In some embodiments, the first clamping element can move in a perpendicular direction to the rotational axis.

In one embodiment of the invention, the holding device has at least one fastening section. The fastening section may have a first sectional side and a second sectional side such that the first sectional side and the second sectional side extend along a first lengthwise axis of the fastening section. The invention may also use at least one guidance seat arranged at the first sectional side of the fastening section. The first guidance seat may comprise a first deep seat. The first deep seat may extend along a second lengthwise axis that is perpendicular to the first lengthwise axis. A second guidance seat may be arranged at the second sectional side of the fastening section. The second guidance seat may comprise a second deep seat. The second deep seat may extend along the second lengthwise axis which is perpendicular to the first lengthwise axis. In some embodiments, the first deep seat may be larger than the second deep seat.

In another embodiment, the first lengthwise axis may be perpendicular to the rotational axis and/or the second lengthwise axis may be perpendicular to the rotational axis.

In one embodiment, the hinge may comprise at least one first clamping device having at least one first guide element and at least one second clamping device having at least one second guide element. The first guide element may have a first expansion extending along the second lengthwise axis. The second guide element may have a second expansion extending along the second lengthwise axis. The first expansion may be larger the second expansion. The hinge can be configured such that the first guide element is arranged in the first guidance seat, and the second guide element is arranged in the second guidance seat. The hinge may also be configured such that the first guide element is arranged in the second guidance seat, and the second guide element is arranged in the first guidance seat.

In one embodiment of the invention, the locking device further comprises a third clamping plane arranged at the articulated axle element. The locking device further comprises at least one second clamping element which is arranged at the holding device. The second clamping element has a fourth clamping plane such that the third clamping plane is located at the fourth clamping plane to lock a relative position of the first joint part in relation to the second joint part. In another embodiment of the invention, the locking element is arranged at the articulated axle element such that the first clamping plane and the third clamping plane are arranged at the locking element.

In another embodiment, at least one locking element is arranged at the articulated axle element such that the first clamping plane is arranged at the locking element. The locking element, for example, may be bushing-shaped and partially surround the articulated axle element. The locking element may also completely surround the articulated axle element. The locking element may also be cuboid-shaped, have at least one chamfered edge, or comprise an axle seat in which the articulated axle element is arranged.

In one embodiment, the articulated axle element has a first end and a second end. The first end is arranged at the basic element and a thread is arranged at the second end. A fastening element is arranged at the thread such that the fastening element can be changed from an unlocked position into a locked position.

In another embodiment, the first clamping element is arranged in a first clamping element seat on the holding device. The first clamping element seat may have a first receiving end and a second receiving end. The first receiving end may be closed by a lock that supports a first end of a spring. The second end of the spring is supported by the first clamping element. The first clamping element is arranged at the second receiving end.

Other features of the invention can be found in the following description, the enclosed claims and/or the attached drawings.

BRIEF DESCRIPTION OF THE DRAWINGS

For a fuller understanding of the nature and objects of the invention, reference should be made to the accompanying drawings and the subsequent description. Briefly, the drawings are:

FIG. 6 is a schematic drawing of an articulated axle element in keeping with the present invention;

FIG. 7 is a sectional view along line A-A in FIG. 6;

FIG. 8 is a schematic drawing of a locking device in keeping with the present invention;

FIG. 9 is a top view of the locking device in FIG. 8;

FIG. 17 is a schematic drawing of a first clamping element in keeping with the present invention;

FIG. 18 is a top view of the first clamping element in FIG. 17;

FIG. 19 is a sectional view along line B-B in FIG. 18;

FIG. 20 is a schematic drawing of a locking device in keeping with the present invention;

FIG. 21 is a schematic side view of the locking device in FIG. 20;

FURTHER DESCRIPTION OF THE INVENTION

Figure 1:
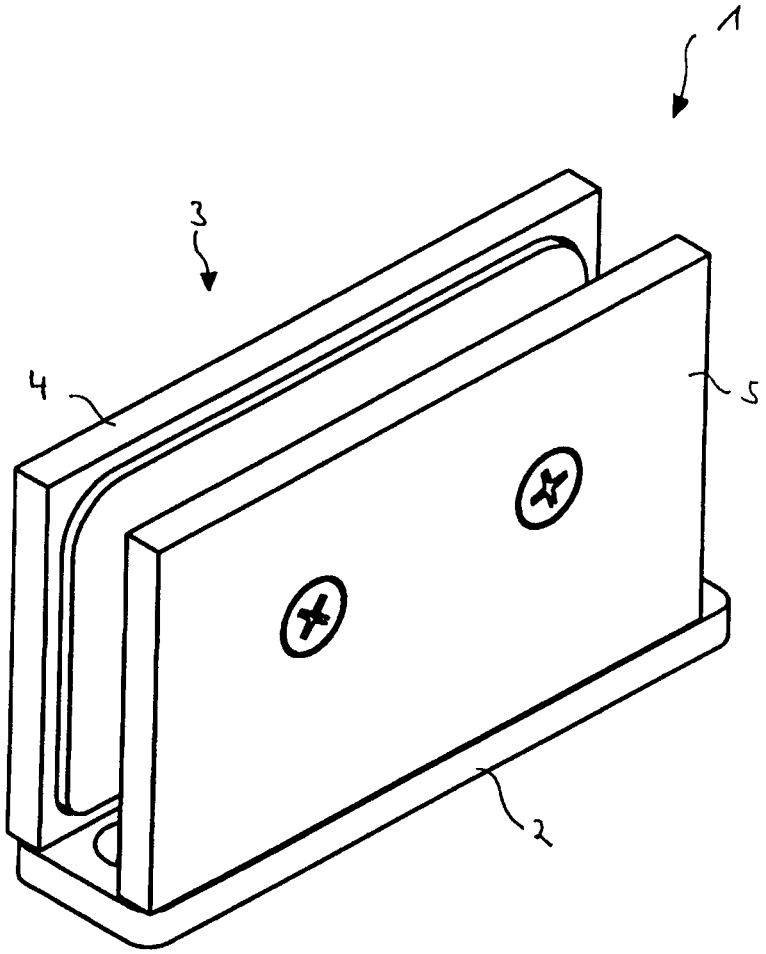
FIG. 1 is a schematic drawing of an exemplary embodiment of a hinge in keeping with the present invention.

The hinge of the invention is intended for example for a door or a window. The invented hinge joint is especially designed to hold and guide a door used as a boundary for a shower for example. The invention is particularly designed for a glass door. The invented hinge comprises at least a first joint part and at least a second joint part, where both are connected by at least one articulated axle, so that the first joint part can rotate in relation to the second joint part around a rotational axis. The invented hinge furthermore comprises at least one locking device to lock the first joint part in a relative position with respect to the second joint part. The relative position is for example the open position or the closed position of a door. The invented hinge furthermore comprises a basic element arranged at the first joint part. This basic element is the first joint part for example. Another configuration provides additionally, or as an alternative, that the basic element is plate-shaped.

In addition, the invented hinge comprises at least one holding device arranged at the second joint part. This holding device comprises at least one articulated axle seat. The articulated axle element is arranged in the articulated axle seat and is arranged at the basic element as well. The articulated axle element comprises a rotational axis around which the first joint part can rotate in relation to the second joint part.

The locking device of the invented hinge comprises at least a first clamping plane arranged at the articulated axle element. It is understood here and afterwards that a plane means a two-dimensional formation. An arrangement of the first clamping plane on the articulated axle element encompasses any such arrangement, also for example an arrangement of the first clamping plane in the articulated axle element. In addition the locking device comprises at least a first clamping element arranged at the holding device, wherein the first clamping element comprises a second clamping plane. This arrangement of the first clamping element at the holding device also comprises any arrangement of the first clamping element at the holding device, thus also an arrangement of the first clamping element in the holding device for example. The first clamping plane is arranged at the second clamping plane to lock the relative position of the first joint part in relation to the second joint part. In other words, to lock a relative position of the first joint part in relation to the second joint part, the first clamping element is arranged with the second clamping plane at the first clamping plane so that a clamping effect is achieved. This locks the position of the first joint part in relation to the second joint part. For example, the relative position can be an open position or a closed position of a door. The door can rotate around a rotational axis. Locking the relative position ensures that the first joint part can always be rotated in relation to the second joint part into this relative position, and can be securely locked in this relative position.

One configuration of the invention provides, in addition or as an alternative, that the locking device comprises at least a third clamping plane which is arranged at the articulated axle element, wherein its arrangement is defined in the above explanation. The locking device furthermore comprises at least a second clamping element arranged at the holding device. This arrangement is also defined in the above explanation. The second clamping element comprises a fourth clamping plane. The third clamping plane is arranged at the fourth clamping plane for locking the relative position of the first joint part in relation to the second joint part.

It is explicitly pointed out that the invention is not limited to a single clamping element or two clamping elements. The invented hinge can rather comprise any suitable number of clamping elements, for example four clamping elements. For example, in addition or as an alternative to, another configuration of the invented hinge provides that the latter comprises a third clamping element with a fifth clamping plane and a fourth clamping element with a sixth clamping plane. To lock the relative position of the first joint part in relation to the second joint part, the fifth clamping plane is arranged at a seventh clamping plane and the sixth clamping plane is arranged at an eighth clamping plane, wherein the seventh clamping plane and the eighth clamping plane are arranged at the articulated axle element.

Another configuration of the invented hinge provides in addition or as an alternative, that at least one locking element is arranged at the articulated axle element. The locking element comprises at least one of the above named clamping planes of the articulated axle element, thus for example the first clamping plane, the third clamping plane, the seventh clamping plane and/or the eighth clamping plane. It is provided that the locking element is bushing-shaped for example, and at least partially surrounds the articulated axle element. An alternative provides for the locking element to fully surround the articulated axle element.

Still another configuration of the invented hinge provides, in addition and/or as an alternative, for the locking element to comprise at least one of the following characteristics: the locking element is cuboid-shaped, the locking element comprises an axle seat where the articulated axle element is arranged, or the locking element comprises at least one chamfered edge.

Yet another configuration of the invented hinge provides in addition or as an alternative, that the articulated axle element comprises a first end and a second end. The first end is arranged at the basic element. In addition, a thread is provided on the second end of the articulated axle element. A fastening element is arranged at this thread. This fastening element is moveable so that it can be changed from a loose condition to a locked condition. The fastening element is used to adjust the location of the above named relative position. For example by loosening the fastening element and rotating the second joint part in relation to the first joint part around the rotational axis, the articulated axle element (and thereby also the clamping plane(s) arranged at the articulated axle element) are carried along. Tightening the fastening element anchors the position of the articulated axle element (and thereby also the clamping plane(s) arranged at the articulated axle element). This configuration allows the relative position of the first joint part to be adjustable in relation to the second joint part.

Another configuration of the invented hinge provides in addition or as an alternative, that the first clamping element is arranged in a first clamping element seat in the holding device. The first clamping element seat comprises a first receiving end and a second receiving end, wherein the first receiving end is closed by a plug. A spring element is located in the clamping element seat. A first spring element end is supported by the plug and a second spring element end is supported by the first clamping element. The latter is located on the second receiving end. The spring element ensures that the second clamping plane of the first clamping element is pressed against the first clamping plane of the articulated axle element with sufficient force to achieve a clamping effect.

Still another configuration of the invention provides, in addition or as an alternative, that the first clamping element is arranged at the holding device so that it can move in a direction perpendicular to the rotational axis.

Another configuration of the invented hinge provides in addition or as an alternative, that the holding device comprises at least one fastening section. The latter comprises a first section side and a second section side, wherein the first section side and the second section side extend along a first lengthwise axis of the fastening section. The first section side and the second section side for example are parallel and/or at a distance from each other. The first section side of the fastening section comprises at least a first guidance seat which includes a first receiving depth. The latter extends along a second lengthwise axis that is perpendicular to the first lengthwise axis. Furthermore, at least a second guidance seat is arranged at the second section side of the fastening section, wherein the second guidance seat comprises a second receiving depth and the latter extends along the second lengthwise axis, which is perpendicular to the first lengthwise axis. Furthermore, the first receiving depth is larger than the second receiving depth. For example, in addition or as an alternative, it is provided that the first lengthwise axis and/or the second lengthwise axis are perpendicular to the rotational axis. Furthermore and in addition or as an alternative for example, it is provided that the hinge comprises at least a first clamping device with at least a first guide element, and at least a second clamping device with at least a second guide element. The leaf of a door, for example the leaf of a glass door, can be held and clamped between the first clamping device and the second clamping device. To allow placing a door leaf of a different thickness between the first clamping device and the second clamping device, it is now provided that a first expansion of the first guide element extends along the second lengthwise axis, and that a second expansion of the second guide element extends along the second lengthwise axis. The first expansion is larger than the second expansion. The first guide element is arranged in the first guidance seat and the second guide element is arranged in the second guidance seat to securely hold a door leaf of a first thickness between the first clamping device and the second clamping device. To securely hold a door leaf of a second thickness that is different from the first thickness, between the first clamping device and the second clamping device, the first guide element is arranged in the second guidance seat, and the second guide element is arranged in the first guidance seat. The above configuration enables the use of door leaves of different thicknesses.

FIG. 1 is a schematic drawing of an embodiment of the invented hinge 1. It comprises a first joint part 2 in the form of a plate-shaped basic element and a second joint part 3.

Figure 30:
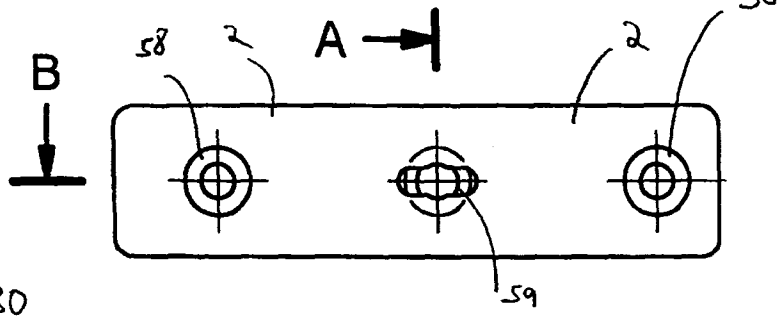
FIG. 30 is a top view of a plate-shaped first joint part in keeping with the present invention.
Figure 32:
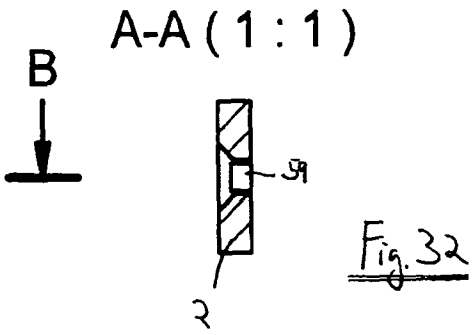
FIG. 32 is a sectional view along line A-A in FIG. 30.
Figure 31:
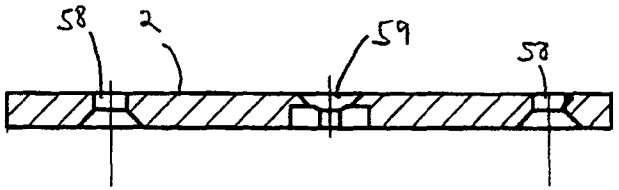
FIG. 31 is a sectional view along line B-B in FIG. 30.

The first joint part 2 is shown again in FIGS. 30 to 32. It comprises connecting elements 58 in the form of holes whereby the first joint part 2 can be arranged at a wall or a shower stall for example. Furthermore a connecting unit 59 is provided, which will be explained in more detail later.

The second joint part 3 is used to receive and secure a door leaf (not illustrated), for example the leaf of a glass door. The door leaf is clamped and securely held between a first clamping device 4 and a second clamping device 5.

Figure 3:
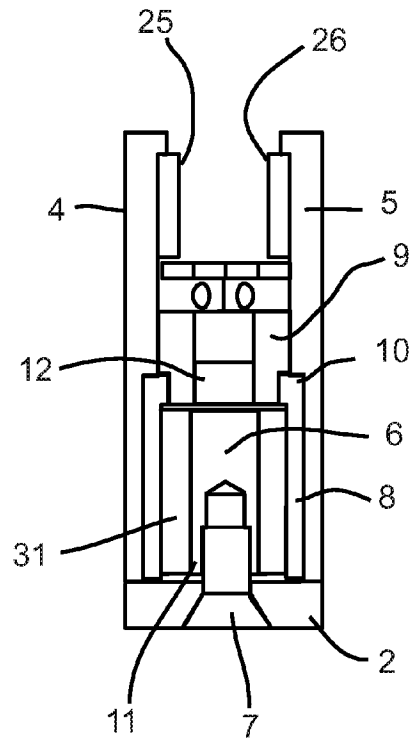
FIG. 3 is a sectional view along line A-A in FIG. 2.
Figure 2:
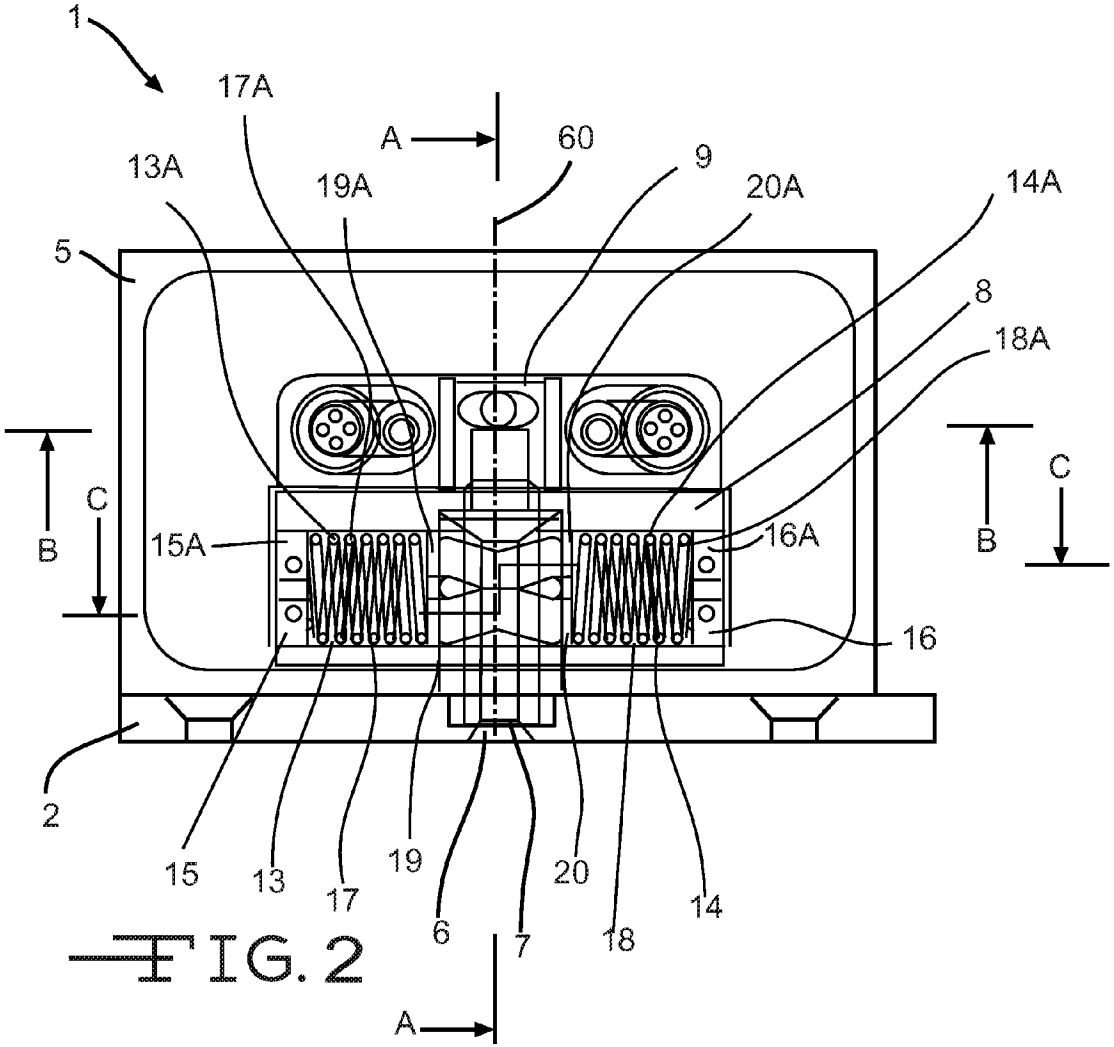
FIG. 2 is a sectional view of the hinge in FIG. 1.

FIG. 2 is another schematic drawing of the hinge 1 in FIG. 1. FIG. 3 is a sectional view of the hinge 1 in FIG. 2 along line A-A. The hinge 1 comprises an articulated axle element 6 which is attached by a screw connection 7 to the connecting unit 59 of the first joint part 2. FIGS. 6 and 7 show the articulated axle element 6 in greater detail. FIG. 6 is a schematic side view of the articulated axle element 6. FIG. 7 is a sectional view along line A-A in FIG. 6. The articulated axle element 6 comprises a first end 11 and a second end 12. The articulated axle element 6 also comprises a lengthwise axis designed as a rotational axis 60. The first joint part 2 can rotate in relation to the second joint part 3 around this rotational axis 60.

The first end 11 is attached to the first joint part 2 by a screw connection 7. A locking device 31 is arranged in the area of the first end 11 and has a cuboid-bushing shape. FIG. 8 is a schematic drawing of the locking device 31. FIG. 9 is a top view of the locking device 31. The latter comprises a central axle seat 32 where the articulated axle element 6 is arranged.

Thus the locking device 31 fully encloses the articulated axle element 6. The locking device 31 additionally comprises four clamping planes at 90° from each other, namely a first clamping plane 29, a second clamping plane 30, a seventh clamping plane 33 and an eighth clamping plane 34. Each two of the mentioned clamping planes of the locking device 31 are interconnected by means of chamfered edges 35.

Figure 11:
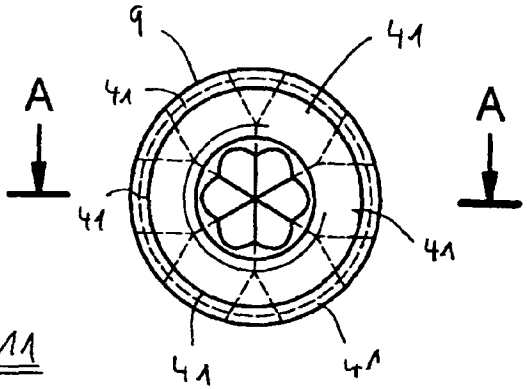
FIG. 11 is a top view of the fastening element in FIG. 10.
Figure 10:
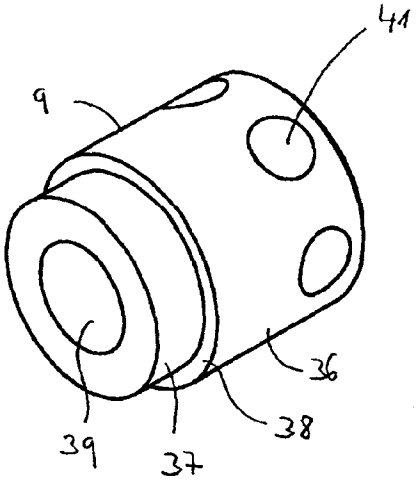
FIG. 10 is a schematic drawing of a fastening element in keeping with the present invention.
Figure 12:
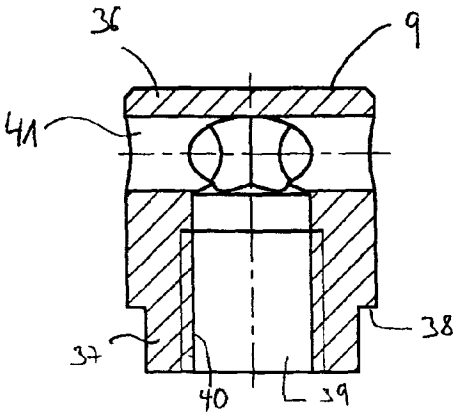
FIG. 12 is a sectional view along line A-A in FIG. 1 I.

The second end 12 of the articulated axle element 6 is equipped with a thread 10 on which a fastening element 9 is arranged. The latter is shown in detail in FIGS. 10 to 12. It comprises a cylindrical structure in two stages, namely a first stage 36 and a shouldered stage 37. This creates an edge 38 which can be placed on a holding device 8. The fastening element 9 contains a hole 39 equipped with an internal thread 40. The thread 40 of the fastening element 9 and thread 10 of the articulated axle element 6 interlock. The first stage 36 comprises 6 openings 41, wherein each two of the openings 41 are arranged from each other by 60°. The openings 41 are used for a tool whereby the fastening element 9 can be rotated around the rotational axis 60. The fastening element 9 is moveable so that it can be changed from a separated condition into a locked condition. It is used to adjust the location of the above named relative position. Loosening the fastening element 9 makes it possible for example that, by rotating the second joint part 3 in relation to the first joint part 2 around the rotational axis 60, the articulated axle element 6 (and thereby also the clamping plane (s) arranged thereon) can be carried along. Tightening the fastening element 9 locks the position of the articulated axle element 6 (and thereby also the clamping plane(s) arranged on the latter). In this way the relative position of the first joint part 2 is adjustable in relation to the second joint part 3.

Figure 13:
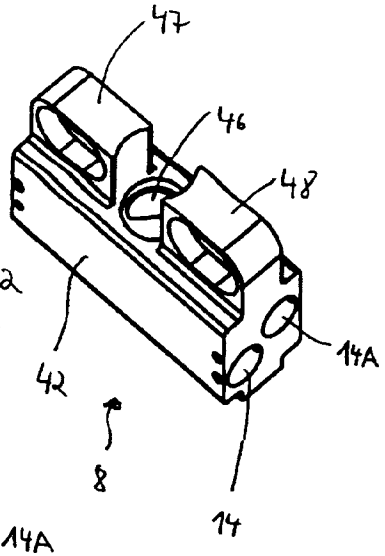
FIG. 13 is a schematic drawing of a holding device in keeping with the present invention.
Figure 16:
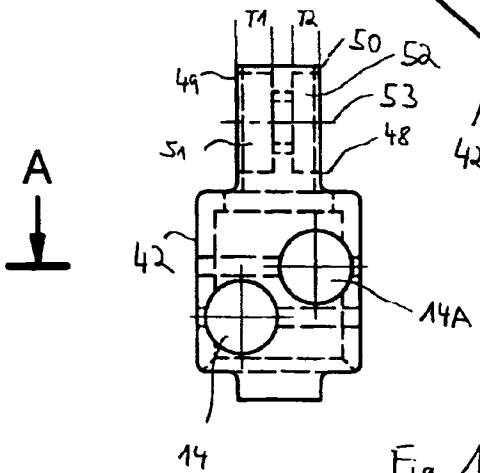
FIG. 16 is a top view of the holding device from direction C in FIG. 14.
Figure 14:
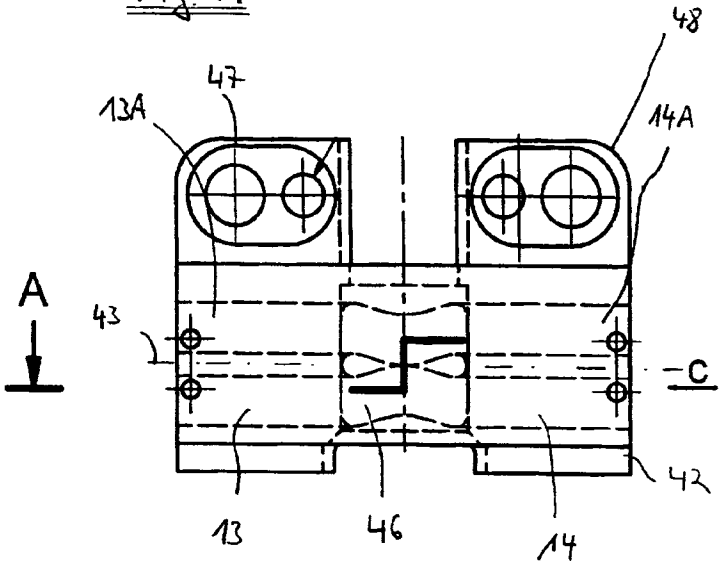
FIG. 14 is a schematic side view of the holding device in FIG. 13.
Figure 15:
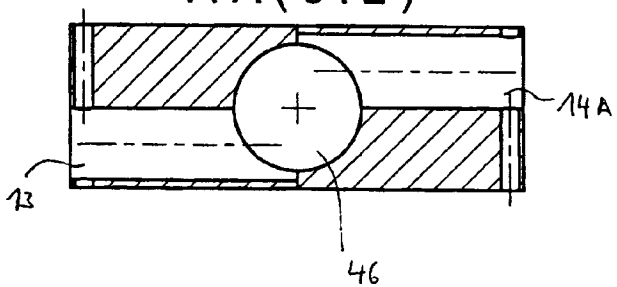
FIG. 15 is a sectional view along line A-A in FIG. 14.
Figure 23:
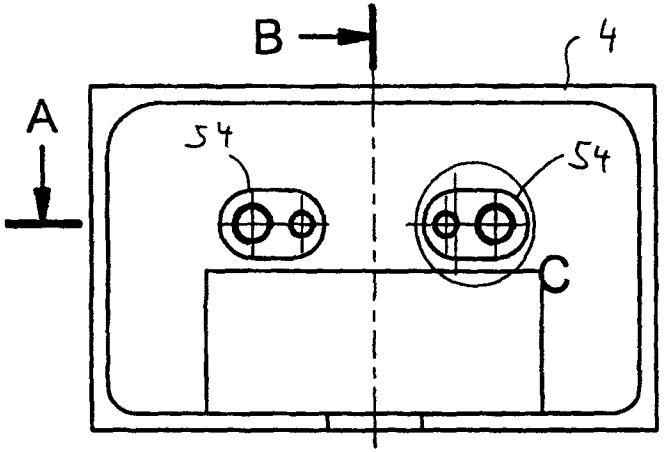
FIG. 23 is a schematic side view of the first clamping device in FIG. 22.
Figure 24:
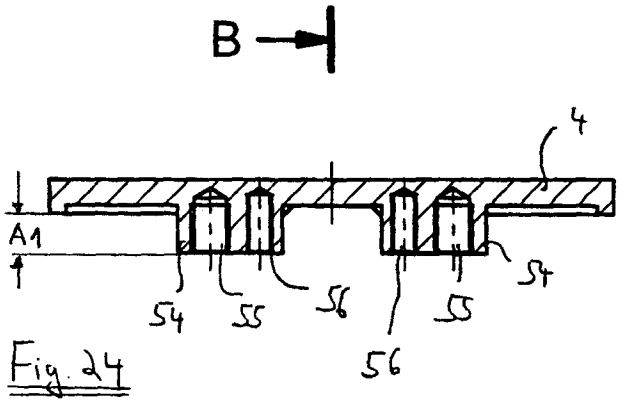
FIG. 24 is a sectional view along line A-A in FIG. 23.
Figure 25:
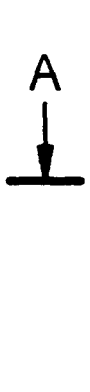
FIG. 25 is a sectional view along line B-B in FIG. 23.
Figure 22:
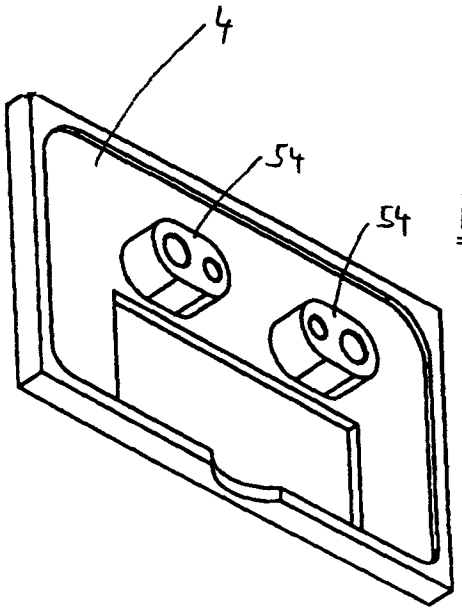
FIG. 22 is a schematic drawing of a first clamping device in keeping with the present invention.
Figure 27:
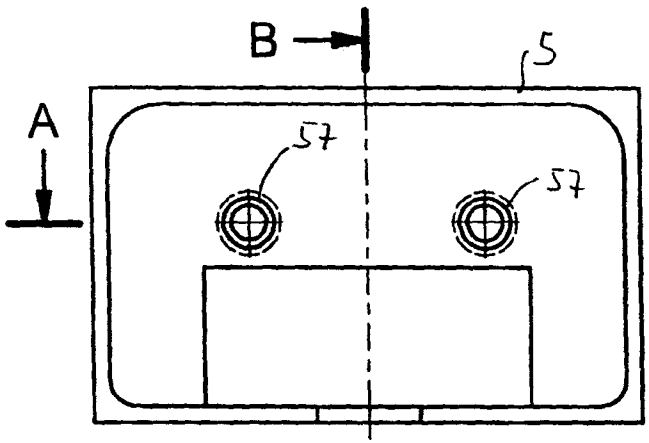
FIG. 27 is a schematic side view of the second clamping device in FIG. 26.
Figure 28:
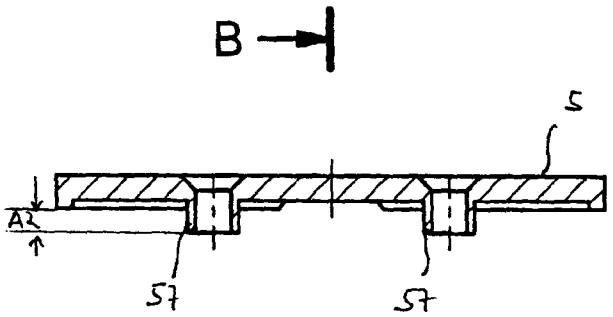
FIG. 28 is a sectional view along line A-A in FIG. 27.
Figure 29:
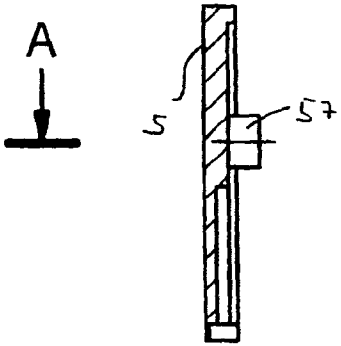
FIG. 29 is a sectional view along line B-B in FIG. 27.
Figure 26:
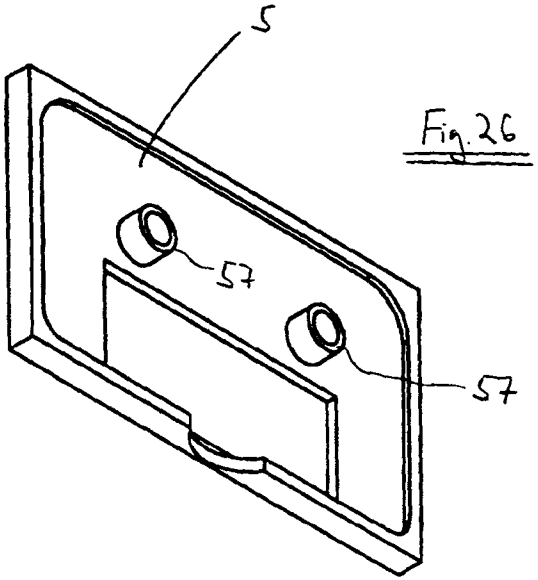
FIG. 26 is a schematic drawing of a second clamping device in keeping with the present invention.

As shown in FIGS. 2 and 3, the articulated axle element 6 and the locking device 31 arranged at the articulated axle element 6 are arranged in the holding device 8. FIGS. 13 to 15 are detailed drawings of the holding device 8. The latter comprises a basic element 42 with four clamping element seats, namely a first clamping element seat 13, a second clamping element seat 14, a third clamping element seat 13A and a fourth clamping element seat 14A. Each of these four clamping element seats is a hole for example, wherein the lengthwise axes of the hole are parallel to a first lengthwise axis 43 of the basic element 42.

The first clamping element seat 13 comprises a first clamping element 19. FIGS. 17 to 19 show another drawing of the first clamping element 19. The latter is bushing-shaped and comprises a spring element seat 44 at one end. Another end of the first clamping element 19 comprises a inclined second clamping plane 27.

The first clamping element seat 13 comprises a first receiving end and a second receiving end, wherein the first receiving end is closed by a first closing element 15. The latter is also shown in FIGS. 20 and 21. It comprises a pin opening 45 wherein a (not illustrated) pin can be arranged to lock the first closing element 15 on the holding device 8. The first closing element 15 closes the first clamping element seat 13. A first spring element 17 is arranged in the first clamping element seat 13. A first end of the spring element is supported by the first closing element 15, and a second end of the spring element is supported by the first clamping element 19, wherein the second end of the spring element is arranged in the spring element seat 44 of the first clamping element 19. The latter is arranged at the second receiving end of the first clamping element seat 13.

The second clamping element seat 14 comprises a second clamping element 20. The second clamping element 20 has the same construction as the first clamping element 19.

The second clamping element seat 14 also comprises a first receiving end and a second receiving end, wherein the first receiving end is closed by a second closing element 16. The latter has the same construction as the first closing element 15. The second closing element 16 closes the second clamping element seat 14. A second spring element 18 is arranged in the second clamping element seat 14. A first spring end is supported by the second closing element 16, and a second spring end is supported by the second clamping element 20, wherein the second spring end is arranged in the spring element seat 44 of the second clamping element 20. The latter is arranged on the second receiving end of second clamping element seat 14.

A third clamping element 19A is arranged in the third clamping element seat 13A. The third clamping element 19A has the same construction as the first clamping element 19.

The third clamping element seat 13A also comprises a first receiving end and a second receiving end, wherein the first receiving end is closed by a third closing element 15A. The third closing element 15A has the same construction as the first closing element 15. The third closing element 15A closes the third clamping element seat 13A. A third spring element 17A is arranged in the third clamping element seat 13A. A first spring element end is supported by the third closing element 15A, and a second spring element end is supported by the third clamping element 19A, wherein the second spring element end is arranged in the spring element seat 44 of the third clamping element 19A. The third clamping element 19A is arranged at the second receiving end of the third clamping element seat 13A.

A fourth clamping element 20A is arranged in the fourth clamping element seat 14A. The fourth clamping element 20A has the same construction as the first clamping element 19.

The fourth clamping element seat 14A also comprises a first receiving end and a second receiving end, where the first receiving end is closed by a fourth closing element 16A. The fourth closing element 16A has the same construction as the first closing element 15. The fourth closing element 16A closes the fourth clamping element seat 14A. A fourth spring element 18A is arranged in the fourth clamping element seat 14A. A first spring end is supported by the fourth closing element 16A, and a second spring end is supported by the fourth clamping element 20A, wherein the second spring end is arranged in the spring element seat 44 of the fourth clamping element 20A. The fourth clamping element 20A is arranged at the second receiving end of the fourth clamping element seat 14A.

All the preceding clamping elements in the holding device 8 can move in one direction, perpendicular to the rotational axis 60.

The basic element 42 of holding device 8 comprises an articulated axle seat 46 in which the articulated axle element 6 and the locking device 31 are arranged.

In the adjustable relative position of the first joint part 2 in relation to the second joint part 3, the second clamping plane 27 of the first clamping element 19 is located on the first clamping plane 29 of locking device 31. Furthermore, a fourth clamping plane 28 of the second clamping element 20 is located on the third clamping plane 30 of locking device 31. The fifth clamping plane of the third clamping element 19A is located on the seventh clamping plane 33 of locking device 31. However, the sixth clamping plane 28A of the fourth clamping element 20A is located on the eighth clamping plane 34 of locking device 31. The above named spring elements ensure that the named clamping planes of the individual clamping elements are pressed against the clamping planes of locking device 31 with sufficient force to achieve a clamping effect. In this way the first joint part 2 is locked in a predetermined relative position with respect to the second joint part 3. For example, the relative position is an open position or a closed position of a door. The door can swing around the rotational axis 60. Locking the relative position ensures that the first joint part 2 can always be swung in relation to the second joint part 3 into this relative position, where it is secured.

The holding device 8 comprises two fastening sections arranged at the basic element 42, namely a first fastening section 47 and a second fastening section 48. The first fastening section 47 and the second fastening section 48 have essentially the same construction so that only the second fastening section 48 will be described in the following. A first sectional side 49 and a second sectional side 50 are arranged at the second fastening section 48, wherein the first sectional side 49 and the second sectional side 50 extend along the first lengthwise axis 43. A first guidance seat 51 is arranged at the first sectional side 49, wherein the first guidance seat 51 comprises a first deep seat T1. The first deep seat T1 extends along a second lengthwise axis 53 that is perpendicular to the first axis 43. Furthermore, a second guidance seat 52 is arranged at the second sectional side 50, wherein the second guidance seat 52 comprises a second deep seat T2. The second deep seat T2 extends along the second lengthwise axis 53. The second deep seat T2 is smaller than the first deep seat T1.

The first lengthwise axis 43 is perpendicular to the rotational axis 60. Moreover, the second lengthwise axis 53 is perpendicular to the rotational axis 60.

Figure 4:
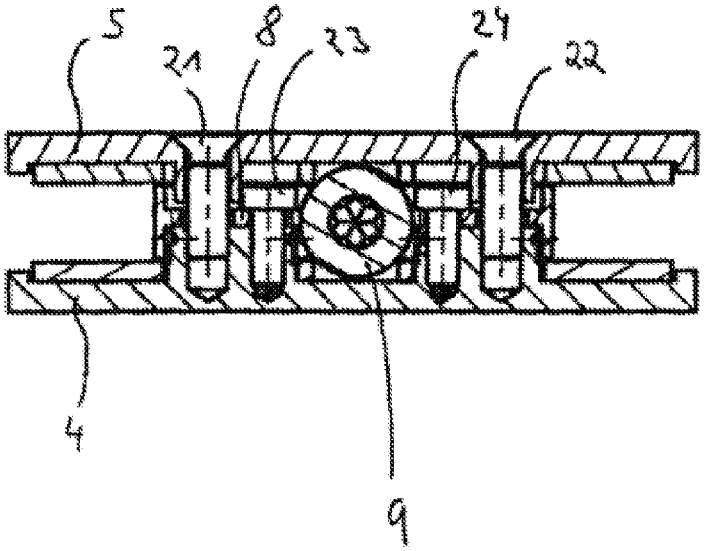
FIG. 4 is a sectional view along line B-B in FIG. 2.
Figure 5:
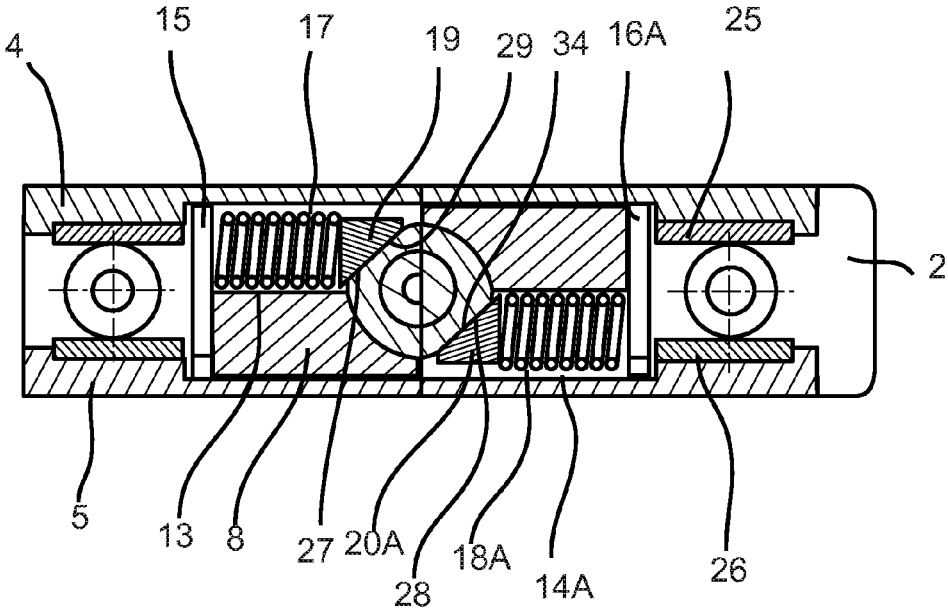
FIG. 5 is a sectional view along line C-C in FIG. 2.

As mentioned earlier, the hinge 1 comprises the first clamping device 4 and the second clamping device 5. The first clamping device 4 is shown again in FIGS. 22 to 25. The first clamping device 4 comprises two first guide elements 54 in the form of studs, wherein each stud has a first thread 55 and a second thread 56. The first thread 55 receives a first locking bolt 21 or a second locking bolt 22 (see FIG. 4), so that the door leaf is securely clamped between the first clamping device 4 and the second clamping device 5. The second thread 56 places the holding device 8 on the first clamping device 4 with a first attaching screw 23 or a second attaching screw 24 (see FIG. 4). The second clamping device 5 is shown again in FIGS. 26 to 29. Two second guide elements 57 in the form of studs are arranged at the second clamping device 5. They receive the first locking bolt 21 or the second locking bolt 22.

A first cushion element 25 can be arranged at the first clamping device 4. And a second cushion element 26 can be arranged at the second clamping device 5. The first cushion element 25 and the second cushion elements 26 serve to cushion the (not illustrated) door leaf.

To enable placing a different thickness door leaf between the first clamping device 4 and the second clamping device 5, it is provided that the first guide elements 54 extend along the second lengthwise axis 53 comprising a first expansion A1, and that the second guide elements 57 extend along the second lengthwise axis 53 comprising a second expansion A2. The first expansion A1 is larger than the second expansion A2. The first guide elements 54 are arranged in the first guidance seats 51 to enable a secure clamping of a door leaf with a first thickness between the first clamping device 4 and the second clamping device 5. Furthermore, the second guide elements 57 are arranged in the second guidance seats 52. The first guide elements 54 are arranged in the second guidance seats 52 to enable the secure clamping of a door leaf with a second thickness, different from the first one, between the first clamping device 4 and the second clamping device 5. The second guide elements 57 are located in the first guidance seats 51.

Please note that a plain bearing can be arranged between the first joint part 2 and the second joint part 3 to ease the rotation of the first joint part 2 in relation to the second joint part 3.

Although the present invention has been described with respect to one or more particular embodiments, it will be understood that other embodiments of the present invention may be made without departing from the spirit and scope of the present invention. Hence, the present invention is deemed limited only by the appended claims and the reasonable interpretation thereof.

List Of Reference Signs

1 Hinge
2 First joint part (basic element)
3 Second joint part
4 First clamping device
5 Second clamping device
6 Articulated axle element
7 Screw connection
8 Holding device
9 fastening element
10 Thread
11 First end of the articulated axle element
12 Second end of the articulated axle element
13 First clamping element seat
13A Third clamping element seat
14 Second clamping element seat
14A Fourth clamping element seat
15 First closing element
15A Third closing element
16 Second closing element
16A Fourth closing element
17 First spring element
17A Third spring element
18 Second spring element
18A Fourth spring element
19 First clamping element
19A Third clamping element
20 Second clamping element
20A Fourth clamping element
21 First locking bolt
22 Second locking bolt
23 First attaching screw
24 Second attaching screw
25 First cushion element
26 Second cushion element
27 Second clamping plane (first clamping element)
28 Fourth clamping plane (second clamping element)
29 First clamping plane (locking device)
30 Third clamping plane (locking device)
31 Locking device
32 Axle seat
33 Seventh clamping plane (locking device)
34 Eighth clamping plane (locking device)
35 Chamfered edges
36 First stage
37 Second stage
38 Edge
39 Hole
40 Internal thread
41 Openings
42 Basic element
43 First lengthwise axis
44 Spring element seat

45 Pin opening
46 Articulated axle seat
47 First fastening section
48 Second fastening section
49 First sectional side
50 Second sectional side
51 First guidance seat
52 Second guidance seat
53 Second lengthwise axis
54 First guide element
55 First thread
56 Second thread
57 Second guide element
58 Connecting elements
59 Connecting unit
60 Rotational axis
A1 First expansion
A2 Second expansion
T1 First deep seat
T2 Second deep seat

What is claimed is:

1. A hinge, comprising:
a first joint part;
an articulated axle element having a rotational axis;
a second joint part, wherein the first joint part is connected in hinge form to the second joint part around the articulated axle element so that the first joint part can rotate in relation to the second joint part around the rotational axis;
a locking device to lock at least one relative position of the first joint part in relation to the second joint part;
a basic element which is arranged at the first joint part; and a holding device which is arranged at the second joint part, wherein the holding device comprises an articulated axle seat,
wherein
the articulated axle element is arranged at the basic element;
the locking device is arranged in the articulated axle seat;
the locking device comprises a central axle seat in which the articulated axle element is arranged, and a first clamping plane;
a first clamping element arranged at the holding device, the first clamping element comprises a second clamping plane; and
a spring arranged to bias the first clamping element against the locking device, the spring having an axis which does not intersect the rotational axis;
wherein the first clamping plane is located at the second clamping plane to lock a relative position of the first joint part in relation to the second joint part.

2. The hinge according to claim 1, wherein:
the locking device comprises a third clamping plane;
the holding device comprises a second clamping element, wherein the second clamping element comprises a fourth clamping plane, and
the third clamping plane is located at the fourth clamping plane to lock a relative position of the first joint part in relation to the second joint part.

3. The hinge according to claim 1, wherein the locking device is bushing-shaped.

4. The hinge according to claim 1, wherein the locking device comprises at least one of the following features: the locking device is cuboid-shaped, or the locking device comprises at least one chamfered edge.

5. The hinge according to claim 1, wherein:
the articulated axle element comprises a first end and a second end;
the first end of the articulated axle element is arranged at the basic element;
a thread is arranged at the second end of the articulated axle element;
a fastening element is arranged at the thread, and the fastening element can be changed from an unlocked position into a locked position.

6. The hinge according to claim 1, wherein:
the first clamping element is arranged in a first clamping element seat on the holding device;
the first clamping element seat comprises a first receiving end and a second receiving end;
the first receiving end is closed by a lock;
a first end of a spring element is supported by the lock and a second end of the spring element is supported by the first clamping element, and
the first clamping element is arranged at the second receiving end.

7. The hinge according to claim 1, wherein the first clamping element is arranged at the holding device and can move in a perpendicular direction to the rotational axis.

8. The hinge according to claim 1, wherein:
the holding device comprises a fastening section;
the fastening section comprises a first sectional side and a second sectional side, wherein the first sectional side and the second sectional side extend along a first lengthwise axis of the fastening section;
a first guidance seat is arranged at the first sectional side of the fastening section, the first guidance seat comprises a first deep seat, the first deep seat extends along a second lengthwise axis that is perpendicular to the first lengthwise axis; and
a second guidance seat is arranged at the second sectional side of the fastening section, the second guidance seat comprises a second deep seat, the second deep seat extends along the second lengthwise axis which is perpendicular to the first lengthwise axis, and the first deep seat is larger than the second deep seat.

9. The hinge according to claim 8, wherein the hinge comprises at least one of: the first lengthwise axis is perpendicular to the rotational axis, and the second lengthwise axis is perpendicular to the rotational axis.

10. The hinge according to claim 8, wherein:
the hinge comprises a first clamping device with a first guide element;
the hinge comprises a second clamping device with a second guide element;
a first expansion of the first guide element extends along the second lengthwise axis;
a second expansion of the second guide element extends along the second lengthwise axis;
the first expansion is larger than the second expansion, and
wherein the hinge comprises one of the following features:
the first guide element is arranged in the first guidance seat and the second guide element is arranged in the second guidance seat, and
the first guide element is arranged in the second guidance seat and the second guide element is arranged in the first guidance seat.

11. A hinge, comprising:
a first joint part;
an articulated axle element;
a second joint part, wherein the first joint part is connected in hinge form to the second joint part around the articulated axle element so that the first joint part can rotate in relation to the second joint part around a rotational axis;

a locking device to lock at least one relative position of the first joint part in relation to the second joint part;

a basic element which is arranged at the first joint part; and a holding device which is arranged at the second joint part, wherein the holding device comprises an articulated axle seat, and wherein:

the articulated axle element is arranged at the basic element, and the locking device is arranged in the articulated axle seat, and the locking device comprises a central axle seat in which the articulated axle element is arranged, and a first clamping plane and a second clamping plane;

a first clamping element arranged at the holding device, the first clamping element comprises a third clamping plane;

a first spring arranged to bias the first clamping element against the locking device, the first spring having an axis;

a second clamping element arranged at the holding device, the second clamping element comprises a fourth clamping plane;

a second spring arranged to bias the second clamping element against the locking device, the second spring having an axis, wherein the first spring axis and the second spring axis are not aligned and do not intersect the rotational axis;

wherein the first clamping plane is located at the third clamping plane and the second clamping plane is located at the fourth clamping plane to lock a relative position of the first joint part in relation to the second joint part.

12. The hinge according to claim 11, wherein the locking device is bushing-shaped.

13. The hinge according to claim 11, wherein the locking device comprises at least one of the following features: the locking device is cuboid-shaped, or the locking device comprises at least one chamfered edge.

14. The hinge according to claim 11, wherein:

the articulated axle element comprises a first end and a second end;

the first end of the articulated axle element is arranged at the basic element;

a thread is arranged at the second end of the articulated axle element;

a fastening element is arranged at the thread, and wherein the fastening element can be changed from an unlocked position into a locked position.

15. The hinge according to claim 11, wherein the first clamping element is arranged at the holding device and can move in a direction perpendicular to the rotational axis.

16. The hinge according to claim 11, wherein:

the holding device comprises a fastening section;

the fastening section comprises a first sectional side and a second sectional side, the first sectional side and the second sectional side extend along a first lengthwise axis of the fastening section;

a first guidance seat is arranged at the first sectional side of the fastening section, the first guidance seat comprises a first deep seat, the first deep seat extends along a second lengthwise axis that is perpendicular to the first lengthwise axis; and a second guidance seat is arranged at the second sectional side of the fastening section, the second guidance seat comprises a second deep seat, the second deep seat extends along the second lengthwise axis which is perpendicular to the first lengthwise axis, and the first deep seat is larger than the second deep seat.

* * * * *